US005226802A

United States Patent [19]

Nakamura et al.

[11] Patent Number: 5,226,802

[45] Date of Patent: Jul. 13, 1993

[54] VARIABLE-DISPLACEMENT VANE PUMP

[75] Inventors: Keiichi Nakamura, Kariya; Yoshiharu Inaguma, Nagoya; Hideya Kato, Aichi, all of Japan

[73] Assignee: Toyoda Koki Kabushiki Kaisha, Kariya, Japan

[21] Appl. No.: 910,234

[22] Filed: Jul. 9, 1992

[30] Foreign Application Priority Data

Jul. 9, 1991 [JP] Japan ..... 3-61602
Jul. 31, 1991 [JP] Japan ..... 3-215919

[51] Int. Cl.[5] ..... F04B 49/00

[52] U.S. Cl. ..... 417/299; 417/302; 417/310

[58] Field of Search ..... 417/286, 288, 299, 302, 417/303, 304, 310

[56] References Cited

U.S. PATENT DOCUMENTS

| | | | |
|---|---|---|---|
| 4,538,966 | 9/1985 | Nikaido | 417/299 X |
| 4,597,718 | 1/1986 | Nakamo et al. | 417/304 X |
| 4,599,051 | 7/1986 | Numazawa et al. | 417/299 X |
| 4,838,767 | 6/1989 | Ohe et al. | 417/299 X |

*Primary Examiner*—Richard E. Gluck

*Attorney, Agent, or Firm*—Oblon, Spivak, McClelland, Maier & Neustadt

[57] ABSTRACT

A variable-displacement vane pump apparatus is composed of a pump part and a switching valve. The pump part is comprised of a housing, a cam ring, a rotor, plural vanes, side plates, two pairs of intake and exhaust ports formed on the side plates, discharge pressure chambers connecting with the discharge ports, and an intake chamber connected with the intake ports. The pump part is divided into first and second pump portions, and only one of the pump portions is activated by the operation of the switching valve when the load pressure is low. Under such condition, the fluid discharged from the particular pump portion is returned to its intake port. Also, the flow rate of the operation fluid discharged from the pump is adjusted by the flow control valve by returning part of pressurized fluid into the inlet ports. A fluid supplied from a reservoir is energized two times by supercharge effect utilizing the returned fluid from the switching valve and the returned fluid from the flow control valve. The vane pump is further provided with a special arrangement to lower the pressure at the bottoms of slits receiving the vanes at the time period when the slits located in the particular pump portion, thereby reducing the energy loss.

3 Claims, 6 Drawing Sheets

VARIABLE-DISPLACEMENT VANE PUMP

BACKGROUND OF THE INVENTION

1. Field of the Invention

The present invention relates to a variable-displacement vane pump, and more particularly, to a variable-displacement vane pump which is suitable for supplying an operation fluid to an automotive power steering system.

2. Discussion of the Prior Art

A hydraulic pump is used for a power steering system in a vehicle. The amount of the operation fluid which is discharged from the pump is preset so that the pump can support a steering operation sufficiently even under low speed driving, during which the rotational speed of an engine is low. Further, the hydraulic pump discharges the operation fluid in proportion to the rotational speed of the engine. Therefore, the amount of the operation fluid discharged from the pump becomes excessive under high speed driving, during which the rotational speed of the engine is generally high.

To solve the above-mentioned problem, a flow control valve has been generally adopted in the power steering system whereby part of the operation fluid discharged from the pump is returned to the pump through a bypass passage without transmitted to a power assistant mechanism of the power steering system. The high pressurized fluid discharged from the hydraulic pump is led into the flow control valve. An excessive portion of the operation fluid is discharged to the bypass passage to be returned to intake ports formed in the pump. Consequently, a large amount of energy is expended in proportion to the rotational speed of the engine when the engine rotates at a high speed. Namely, the energy is lost under high speed driving, during which little steering support is needed, resulting in an increase of fuel consumption rate of the vehicle.

A switching valve has been conventionally used in the pump in order to reduce the energy loss, as described in Japanese Laid-open Patent Publication No. 60-256579. This is a variable-displacement vane pump which consists of a pump part and a switching valve 1, as shown in FIG. 1. The pump part is mainly comprised of a housing 2, a rotor 6, vanes 7, a cam ring 5, side plates 3 and 4, intake ports 41 and 41', and exhaust ports 31 and 31'. The vane pump is further provided with a discharge pressure chamber 27 which is connected to the exhaust port 31'.

In the switching valve 1 is formed a cylindrical chamber 13 in which a spool 11 and a spring 15 are received. At one end of the spool 11, a pressure chamber 14 is formed to be communicated with the discharge pressure chamber 27. At the other end thereof, a spring chamber 16 is formed to receive the spring 15. The switching valve 1 is further provided with an inlet port 18 and an outlet port 19. Operation fluid is sucked from the inlet port 18 to be led into the intake ports 41 and 41' through the spring chamber 16. The outlet port 19 is connected to the power assistant mechanism of a power steering system via a flow control valve (not shown). The outlet port 19 is connected to the discharge pressure chamber 27 via the pressure chamber 14 formed in the switching valve 1.

With this configuration, when the power assistant mechanism does not operate, the pressure at the outlet port 19 is low. In such state, the difference in pressure between the pressure chamber 14 and the spring chamber 16 is small. The spool 11 is thus placed to the left by the force of the spring 15. As a result, the second intake port 41' is separated from the inlet port 18 by the spool 11, and is connected to the discharge pressure chamber 27 via the cylindrical chamber 13. Under this condition, part of the operation fluid discharged from the exhaust ports 31 and 31' is returned to the second intake port 41' through the discharge pressure chamber 27 and the cylindrical chamber 13, as illustrated by the broken-line arrow in FIG. 1. Namely, the operation fluid is only circulated between the second exhaust port 31' and the second intake port 41'. The pumping action does not occur in such condition. Consequently, the amount of the operation fluid discharged from the pump does not increase and the energy loss during the pumping action is lowered.

The above-mentioned vane pump has a problem that the energy loss cannot be decreased sufficiently, because the operation fluid only circulated between the second exhaust port 31' and the second intake port 41' is pressurized fluid having a high pressure. Namely, when the circulated fluid has a high pressure, the energy loss produced during the circulation cannot be ignored.

To overcome this problem, there has been proposed another variable-displacement pump as disclosed in the Japanese Laid-open Patent Publication No. 61-119472. In this vane pump, the vane pump is divided into a pair of pump portions, each of which has an intake port and an exhaust port. The vane pump is further provided with a switching valve which connects the intake port and exhaust port of a particular pump portion to stop its pumping action when the load pressure is low. Since the operation fluid circulated between the exhaust and intake ports of the particular pump portion is non-pressurized fluid having a low pressure, the energy loss is lowered as compared with the conventional vane pump disclosed in Japanese Laid-open Patent Publication No. 60-256579.

By the way, the vane pump also has a flow control valve, and uses a so-called supercharge effect for efficiently sucking the operation fluid to the pump by using the energy of the operation fluid returned from the flow control valve. However, where the function of the particular pump portion is stopped, the amount of the operation fluid which is returned from the flow control valve is reduced, thereby lowering its supercharge effect. The decrease of the supercharge effect may cause cavitation in the pump chambers.

There is another problem in such vane pump. Though part of the operation fluid is only circulated between one of the exhaust ports and the intake ports, the energy loss during the circulation operation isn't small to be ignored. The reason will be described hereinafter.

When the vane 7 is rotated, a thrust force toward a cam ring 5 acts on the vane 7, as shown in FIG. 2. When a particular pump chamber 56 is located in a particular pump portion which stops it pumping action, operation fluid having low pressure is circulated through the pump chamber 56. In such state, the pressure Ps at the outer end of the vane 7 is low while the pressure Pa at the bottom 61 of a slit **6*a* receiving the vane 7 is the same as that of the operation fluid which is discharged from the other acting pump portion and the pressure of which is therefore high. Accordingly, the vane 7 is pressed to the inner periphery surface of the cam ring 5**. Since the vane pump is operated under this condition, it is impossible to reduce the energy loss sufficiently.

SUMMARY OF THE INVENTION

Accordingly, it is an object of the present invention to provide an improved variable-displacement vane pump wherein the sufficient supercharge effect occurs even if the pumping action is stopped in the particular pump chamber.

Another object of the present invention to provide an improved variable-displacement vane pump capable of reducing the energy loss efficiently as compared to the conventional vane pump.

A variable-displacement vane pump of the present invention comprises a pump housing having a cylindrical inner space, a drive shaft rotatably disposed within the pump housing, a cam ring received in the cylindrical space and formed with an internal cam surface therein, a rotor disposed within the cam ring to be rotated by the drive shaft and having a plurality of slits, a plurality of vanes respectively disposed within the slits for slide movement to define plural pump chambers between the internal cam surface of the cam ring and the rotor, and an inlet passage formed in the pump housing for sucking an operation fluid from a reservoir. A pair of intake ports are formed within the housing at different circumferential locations for leading the operation fluid into the pump chambers. The pair of intake ports are communicated with the inlet passage. A pair of exhaust ports are formed within the housing in alternative relationship with the intake ports for discharging the operation fluid from the pump chambers. The exhaust ports are connected with a discharge pressure chamber. A switching valve is communicated with the intake ports and one of the exhaust ports through a first communication passage and a second communication passage, respectively so as to connect the first and second communication passages when the pressure in the discharge pressure chamber is low. Further, the first communication passage is crossed with the inlet passage for sucking the operation fluid in the inlet passage by supercharge effect.

With this arrangement, in the event that the particular pump portion stops its pumping action by circulating the operation fluid, the supercharge effect is generated two times therein. Therefore, a sufficient amount of the operation fluid is supplied to the intake ports by two times of the supercharge actions. Further, it is possible to eliminate the cavitation. In this way, it is possible to solve the problem of a shortage of the operation fluid supplied to the pump chambers and to prevent the generation of a pressure pulsation and a noise when the particular pump portion stops its pumping action.

In another aspect of the present invention, the variable-displacement vane pump comprises a pump housing having a cylindrical inner space, a drive shaft rotatably disposed within the pump housing, a cam ring received in the cylindrical space and formed with an internal cam surface therein, a rotor disposed within the cam ring to be rotated by the drive shaft and having a plurality of slits, and a plurality of vanes respectively disposed within the slits for slide movement to define plural pump chambers between the internal cam surface of the cam ring and the rotor. A pair of side plates are received in the pump housing in contact with both side surfaces of the cam ring. An inlet passage is formed in the pump housing for sucking an operation fluid from a reservoir. A pair of intake ports are formed in at least one of the side plates at different circumferential locations for leading the operation fluid into the pump chambers located in a first pump portion and the pump chambers located in a second pump portion, respectively. The pair of intake ports are communicated with the inlet passage. A pair of exhaust ports are formed in the side plates in alternative relationship with the intake ports for discharging the operation fluid from the pump chambers located within the first pump portion and the pump chambers located within the second pump portion. A first one of the exhaust ports is directly connected with a discharge pressure chamber and a second one of the exhaust ports is connected with the discharge pressure chamber through a pressure separating means. A switching valve is communicated with the intake ports and the second exhaust port through a first communication passage and a second communication passage, respectively so as to connect the first and second communication passages when the pressure in the discharge pressure chamber is low. The side plates are further formed with a first back pressure groove communicating with bottoms of plural slits receiving the vanes located within the first pump portion, a second back pressure groove communicating with bottoms of plural slits receiving the vanes located within the second pump portion, a first back pressure guide passage communicating the first back pressure groove with the first exhaust port, and a second back pressure guide passage communicating the second back pressure groove with the second exhaust port.

With this configuration, when the particular pump portion stops its pumping action, pressure at the bottoms of the slits in the particular pump portion becomes low, whereby the vanes in the particular pump portion are prevented from being pushed to the cam ring by the radial thrust force. The energy loss due to this thrust force therefore becomes small so that the energy loss is reduced effectively when the particular pump portion stops its pumping action.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
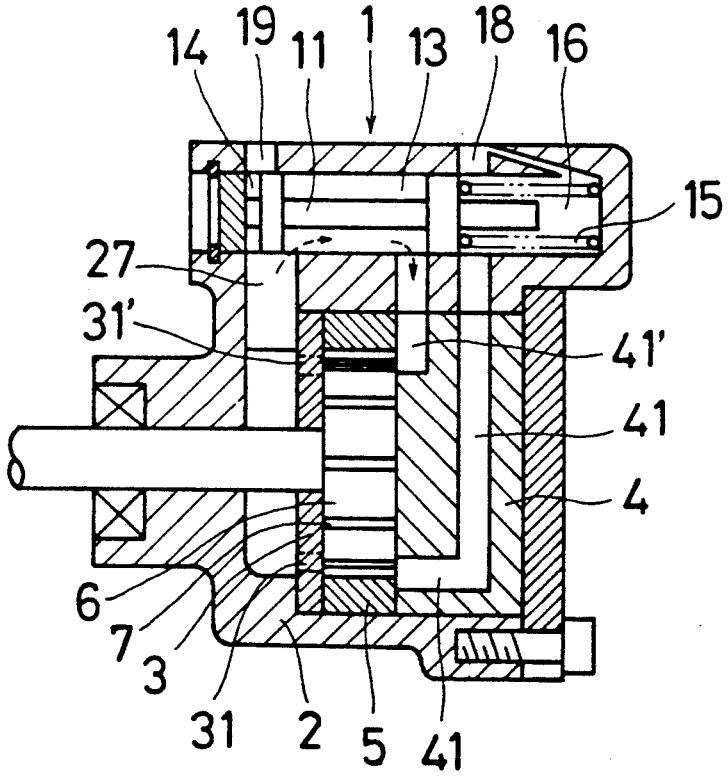
Fig. 1 (Prior Art)
FIG. 1 is a longitudinal sectional view of a variable-displacement vane pump according to the prior art.
Figure 2:
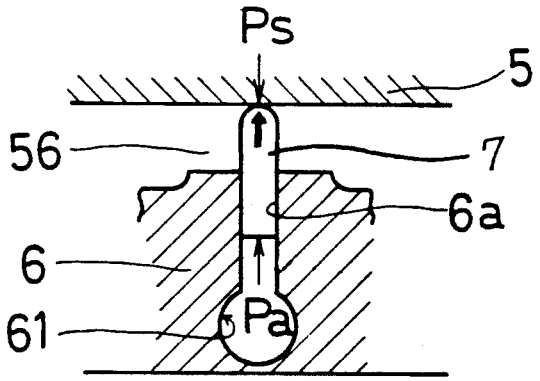
Fig. 2 PRIOR ART
FIG. 2 is a fragmentary sectional view of a particular pump portion illustrating the relationship between a vane, a rotor and a cam ring.
Figure 3:
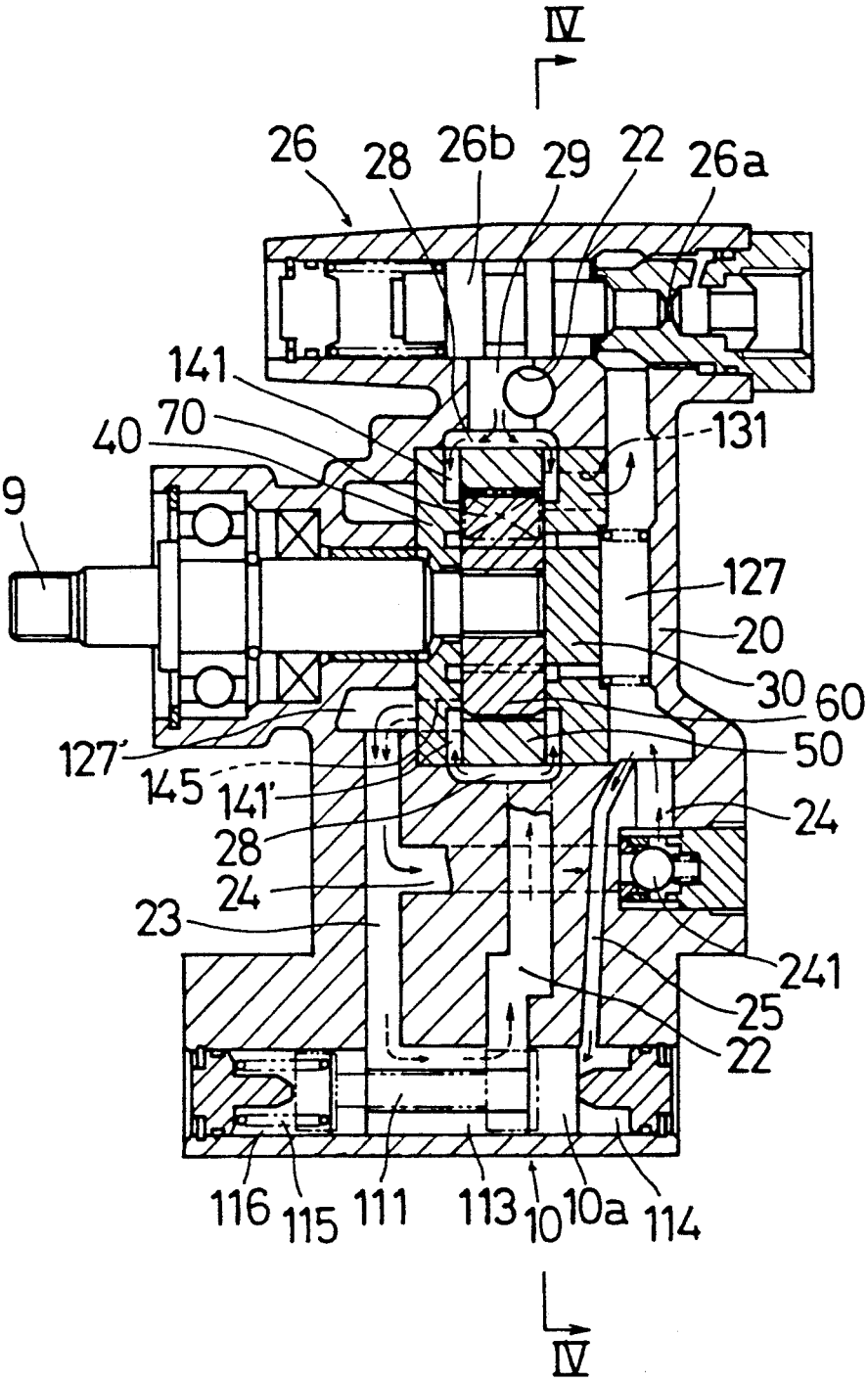
FIG. 3 is a sectional view of a variable-displacement vane pump in accordance with a first embodiment of the present invention.
Figure 4:
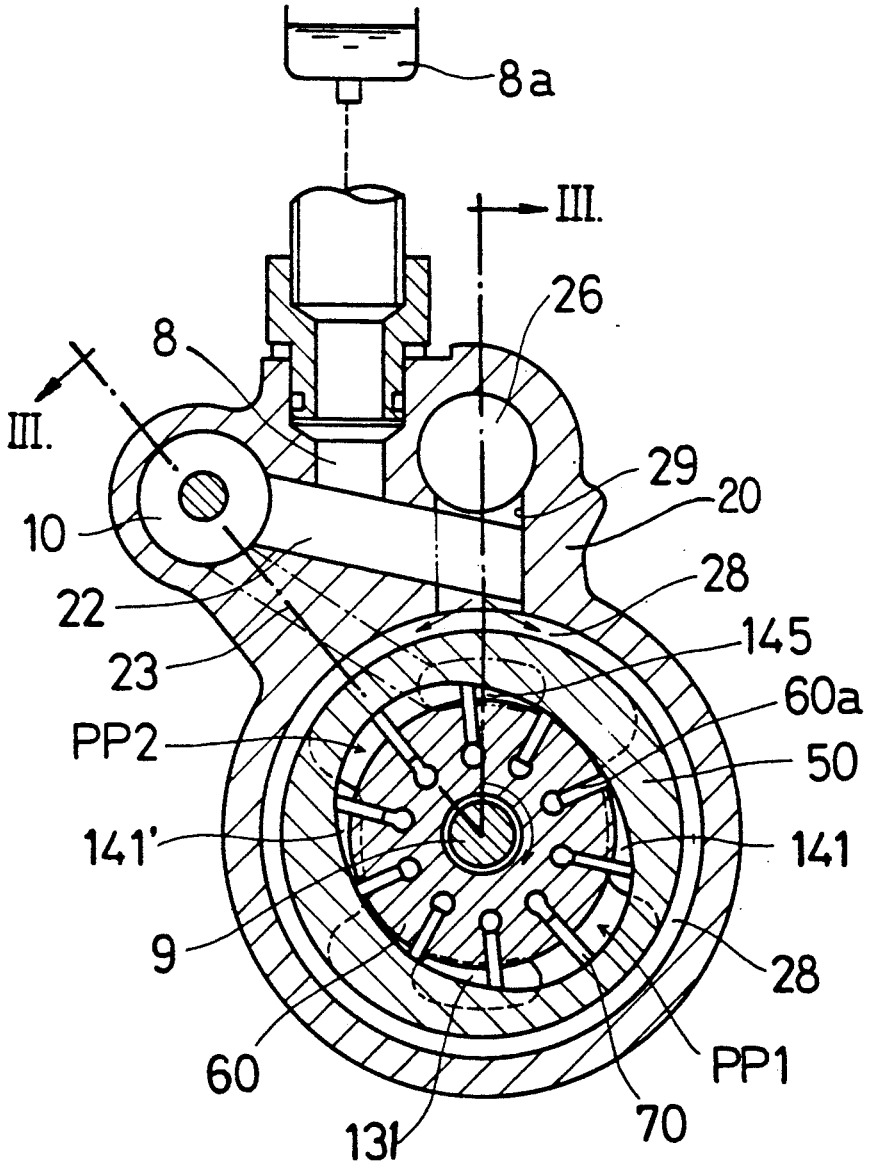
FIG. 4 is a cross-sectional view taken along line IV—IV in FIG. 3

Referring to FIGS. 3 and 4, there is shown the first embodiment of the invention. This is a variable-displacement vane pump which consists of a pump part, a flow control valve 26 and a switching valve 10, as shown in FIG. 3. The pump part is comprised of a cam ring 50 received in a housing 20, a rotor 60 disposed within the cam ring 50 to be rotated by a drive shaft 9, a plurality of vanes 70 respectively disposed within slits 60*a* of the rotor 60 for slide movement, side plates 30 and 40 disposed in contact with both side surfaces of the rotor 60. The vanes 70 and the cam ring 50 define plural pump chambers.

A pair of intake ports 141 and 141' are formed in each of the side plates 30 and 40 at locations close to the outer periphery of the cam ring 50. A first exhaust port 131 is formed in the side plate 30 and a second exhaust port 145 is formed in the side plate 40. As shown in FIG. 4, the intake ports 141 and 141' are formed at opposite sides with respect to the rotational axis of the rotor 60, while the exhaust ports 131 and 145 are formed at circumferential locations between the intake ports 141 and 141' so that the intake ports 141, 141' and the exhaust ports 131, 145 are arranged in alternate fashion in the circumferential direction.

With this arrangement, there are provided a first pump portion PP1 including the intake port 141 and exhaust port 131, and a second pump portion PP2 which includes the intake ports 141' and exhaust port 145. The first exhaust port 131 is connected with a first discharge pressure chamber 127 formed between the side plate 30 and the housing 20. The first discharge pressure chamber 127 is connected with a flow control valve 26 including a valve spool 26*a* which is moved in accordance with the amount of the pressure drop at an orifice 26*a*. An excessive portion of the operation fluid is returned from the flow control valve 26 to the intake ports 141 and 141' through a bypass passage 29 which extends in a radial direction. Communicated with the inner end of the bypass passage 29 is arranged a circular intake chamber 28 which is connected with the intake ports 141 and 141', as illustrated in FIG. 4.

With regard to the switching valve 10, a cylindrical chamber 113 is formed in part of the housing 20. A spool 111 and a spring 115 are received in the cylindrical chamber 113, the spool 111 having a land portion 10*a*. At one end of the spool 111, a pressure chamber 114 is formed to be communicated with the first discharge pressure chamber 127 through a pressure guide passage 25. At the other end of the spool 111, a spring chamber 116 is formed to receive the spring 115 which gives a thrust force to the spool 111 toward the pressure chamber 114.

Plural passages are formed between the pump part and the switching valve 10. Namely, a second discharge pressure chamber 127' is formed at the outer side of the side plate 40, and the second discharge port 145, which is formed in the side plate 40, is opened into the second discharge pressure chamber 127'. The second discharge pressure chamber 127' is connected with a second communication passage 23 from which a third communication passage 24 branches off. The third communication passage 24 is arranged to be communicated with the first discharge pressure chamber 127 via a check valve 241 which allows the operation fluid to flow toward the first discharge pressure chamber 127, but prevents the operation fluid from flowing in the reverse direction. A first communication passage 22 is formed in the housing 20 to be connected at one end thereof with the intake chamber 28. The other end thereof is connected with the cylindrical chamber 113 of the switching valve 10. Both of the switching valve 10 and the flow control valve 26 are arranged at locations above the cam ring 50, and the first communication passage 22 therefore extends in a direction which is slightly inclined with respect to a horizontal direction, as shown in FIG. 4.

An inlet passage 8 for sucking the operation fluid from a reservoir 8*a* is opened to the first communication passage 22 to cross each other. Further, the first communication passage 22 is opened to the bypass passage 29 to cross each other. The first communication passage 22 extends in a direction so that the operation fluid in the first communication passage 22 merges the operation fluid in the inlet passage 8 at an angle equal to 90° or smaller than 90° and that the operation fluid in the first communication passage 22 merges the operation fluid in the bypass passage 29 at an angle equal to 90° or smaller than 90°.

The operation of the first embodiment according to the present invention will now be explained.

Referring to FIGS. 3 and 4, when the vane pump starts the operation, the operation fluid sucked from the inlet passage 8 is led into the intake chamber 28 through the first communication passage 22 and the bypass passage 29. Part of the operation fluid led into the intake chamber 28 is supplied into the first pump portion PP1 through the intake port 141 and then pressurized in the pump portion PP1 to be discharged to the discharge pressure chamber 127 through the first exhaust port 131. Thereafter, the operation fluid is led to the flow control valve 26 and is then discharged to a power assistant mechanism of the power steering system.

When the power assistant mechanism does not operate, the load pressure or back-pressure of the power assistant mechanism is low. The pressure in the first discharge pressure chamber 127 becomes low. Since the pressure chamber 114 formed in the switching valve 10 is connected with the first discharge pressure chamber 127 via the pressure guide passage 25, the pressure in the pressure chamber 114 also becomes low. Under such condition, the spool 111 is moved to the right by the thrust force of the spring 115 to be in the position illustrated by a continuous line in FIG. 3. As a result, the first communication passage 22 is connected with the second communication passage 23. In this state, the operation fluid discharged from the second exhaust port 145 is passed through the discharge pressure chamber 127', the second communication passage 23, the cylindrical chamber 113, the first communication passage 22, and the intake chamber 28, and then supplied into the second pump portion PP2 through the second intake port 141'. Namely, the operation fluid is only circulated through the second pump portion PP2 which includes the second intake port 141 and the second exhaust port 145, and whose the pumping action is stopped. Consequently, the energy loss during the pumping action is reduced.

Under such circumstances, the circulated operation fluid is led from the switching valve 10 to the first communication passage 22, and then led to the bypass passage 29, as shown in FIG. 4. When the circulated operation fluid flows through the first communication passage 22, the circulated operation fluid sucks the operation fluid from the inlet passage 8, at the position where the first communication passage 22 crosses with the inlet passage 8, by supercharge effect. Namely, the operation fluid is efficiently sucked from the inlet passage 8 using the energy of the operation fluid from the switching valve 10. Additionally, the operation fluid returned from the flow control valve 26 sucks the operation fluid in the bypass passage 29 by the supercharge effect. In such a way, when the second pump portion PP2 circulates the operation fluid therethrough, the operation fluid supplied from the inlet passage 8 is led into the intake chamber 28 after being energized by two times of the supercharge action and a sufficient amount of the fluid is supplied to the pump chambers. The operation fluid thus generates no cavitation, resulting in prevention of a noise and a pressure pulsation.

On the contrary, where the pressure in the first discharge pressure chamber 127 increases in response to the load pressure, the pressure in the pressure chamber 114 becomes high. The spool 111 is thus moved to the left against the thrust force of the spring 115 to be in the position indicated by a two-dot chain line in FIG. 3. As a result, the first communication passage 22 is separated from the second communication passage 23 by the land portion 10*a* of the spool 10. In this state, the operation fluid discharged from the second exhaust port 145 is led into the third communication passage 24, as illustrated by the continuous-line arrow in FIG. 3. The check valve 241 is then opened so that the fluid flows into the first discharge pressure chamber 127. Namely, the pumping action of the second pump portion PP2 including the second intake port 141' and the second exhaust port 145 is performed, whereby the increased operation fluid is supplied to the power assistant mechanism. Since no circulation operation fluid is returned from the switching valve 10 in this case, the supercharge effect is only generated at the bypass passage 29 by the fluid returned from the flow control valve 26.

Figure 5:
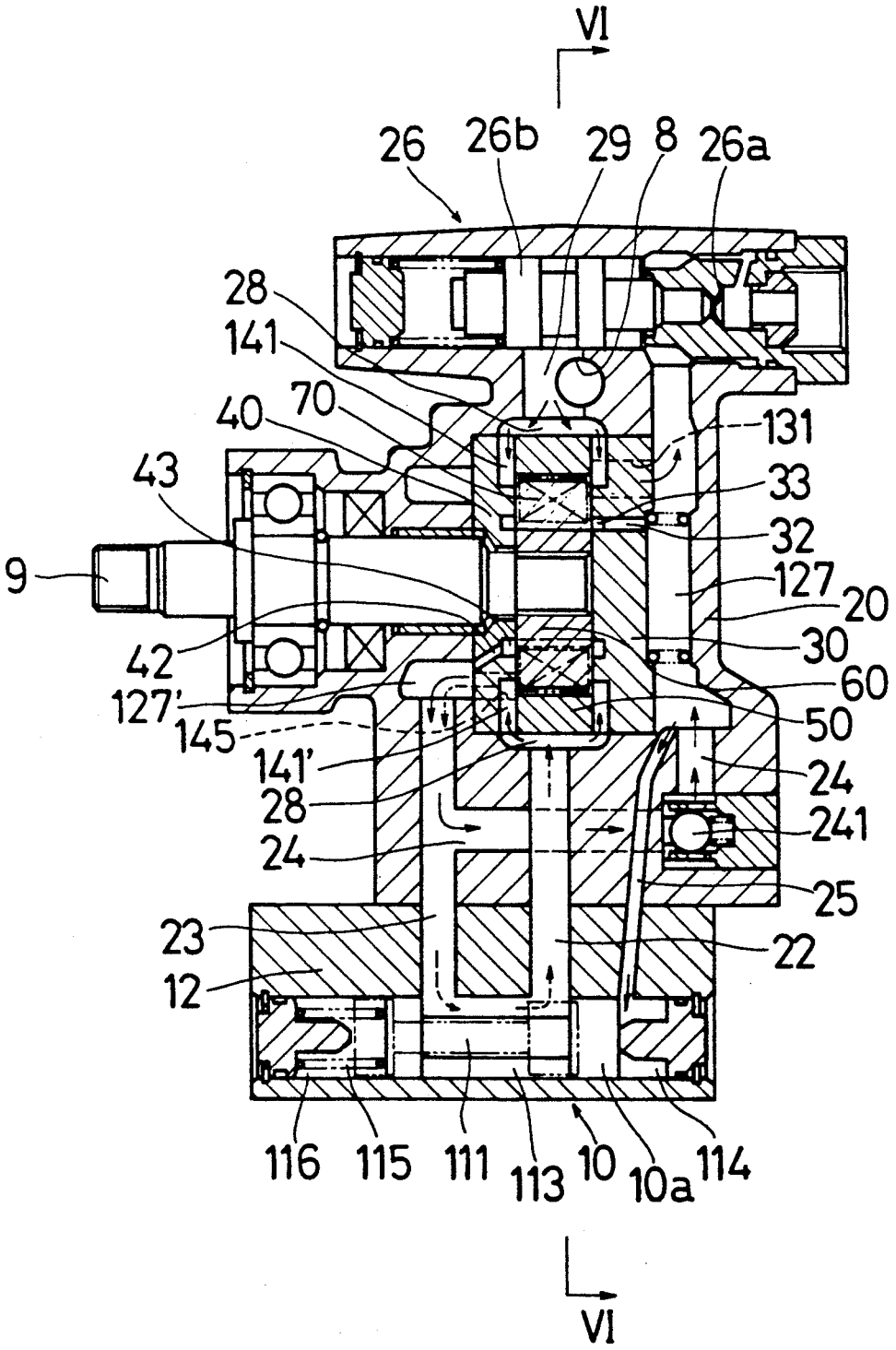
FIG. 5 is a sectional view of a variable-displacement vane pump showing a second embodiment of the present invention.
Figure 6:
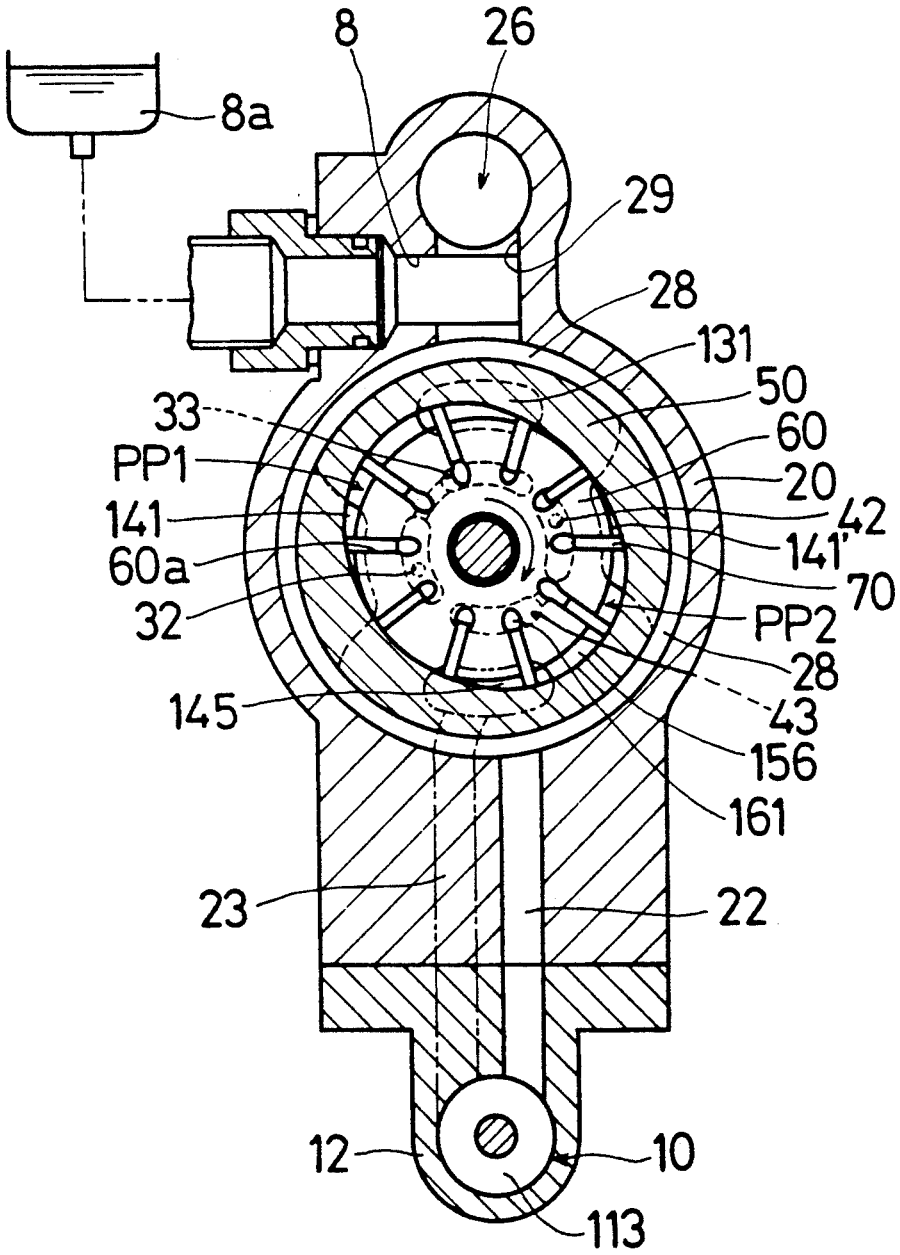
FIG. 6 is a cross-sectional view taken along line VI—VI in FIG. 5.

In FIG. 5 and 6, there is shown a second embodiment of the invention. Parts and members similar to those of the first embodiment will not be described hereinafter.

Each of the side plate 30 and 40 is provided with first and second back pressure grooves 33 and 43 each having a semi-circular shape which are respectively formed at circumferential locations corresponding to the first and second pump portions PP1 and PP2. The side plate 40 having the second exhaust port 145 is further provided with a second back pressure guide passage 42 penetrating the side plate 40. One end of the second back pressure guide passage 42 is opened to the second back pressure groove 43 formed in the side plate 40. The other end thereof is opened to the second discharge pressure chamber 127' communicating with the second discharge port 145. The second back pressure groove 43 supplies the operation fluid to bottoms 161 of the slits 60*a* which receive the vanes 70 in the pump portion PP2 which comprises the second intake and exhaust ports 141' and 145. On the other hand, the side plate 30 is provided with a first back pressure guide passage 32 which is communicated with the first back pressure groove 33 formed in the side plate 30 and the first discharge pressure chamber 127. The first back pressure groove 33 supplies the operation fluid to the bottoms 161 of the slits 60*a* which receive the vanes 70 in the pump portion PP1 which comprises of the first intake and exhaust ports 141 and 131.

By virtue of the above-described arrangement, under low load pressure, the operation fluid of low pressure is led into the bottoms 161 of the slits 60*a* through the second back pressure guide passage 42 and the second back pressure groove 43 formed in the side plate 40. Accordingly, both of the pressure of the pump chambers 156 and the bottoms 161 of the slits 60*a* are the same as the sucked operation fluid having low pressure in the second pump portion PP2. The front ends of the vanes 70 thus contact with the inner periphery of the cam ring 50 gently. Since the vanes 70 are rotated in the cam ring 50 under the gentle contact condition, the energy loss during the rotation of the vanes 70 is reduced the more. Namely, when the power assistant mechanism does not operate, the second pump portion PP2 stops its pumping action by circulating the sucked operation fluid. In addition the reduction of the force which pushes the vanes 70 to the inner periphery of the cam ring 50 causes the reduction of the energy loss due to the friction generated during the rotation of the rotor 60 and the vanes 70. Consequently, it is possible to reduce the energy loss the more.

On the contrary, the pressurized operation fluid is always supplied to the first back pressure groove 33 through the first back pressure guide passage 32. Therefore, the bottoms 161 of the slits 60*a* located in the first pump portion PP1 is supplied with the pressurized fluid. This ensures that the first pump portion PP1 performs its pump action efficiently.

Obviously, numerous modifications and variations of the present invention are possible in light of the above teachings. It is therefore to be understood that within the scope of the appended claims, the present invention may be practiced otherwise than as specifically described herein.

What is claimed is:

1. A variable-displacement vane pump comprising:

a pump housing having a cylindrical inner space;

a drive shaft rotatably disposed within said pump housing;

a cam ring received in the cylindrical space and formed with an internal cam surface therein;

a rotor disposed within said cam ring to be rotated by said drive shaft and having a plurality of slits;

a plurality of vanes respectively disposed within said slits for slide movement to define plural pump chambers between the internal cam surface of said cam ring and said rotor;

an inlet passage formed in said pump housing for sucking an operation fluid from a reservoir;

a pair of intake ports formed within said housing at different circumferential locations for leading the operation fluid into said pump chambers, said pair of intake ports being communicated with said inlet passage;

a pair of exhaust ports formed within said housing in alternative relationship with said intake ports for discharging the operation fluid from said pump chambers, said exhaust ports being connected with a discharge pressure chamber; and a switching valve which is communicated with said intake ports and one of said exhaust ports through a first communication passage and a second communication passage, respectively, so as to connect said first and second communication passages when the pressure in said discharge pressure chamber is low, wherein said first communication passage is crossed with said inlet passage for sucking the operation fluid in said inlet passage by supercharge effect.

2. A vane pump as set forth in claim 1, wherein said vane pump further comprises a flow control valve communicated with said discharge pressure chamber for returning part of the operation fluid from said discharge pressure chamber to said intake ports through a bypass passage, and said first communication passage is formed to be opened to said bypass passage.

3. A vane pump as set forth in claim 2, wherein said flow control valve and said switching valve are disposed to be close to each other, and said bypass passage extends in a radial direction from said flow control valve toward said intake ports, and said first communication passage extends in a direction so that the operation fluid in said first communication passage is merged with the operation fluid in said inlet passage at an angle equal to 90° or smaller than 90° and that the operation fluid in said first communication passage is merged with the operation fluid in said bypass passage at an angle equal to 90° or smaller than 90°.

* * * * *